US006696781B2

(12) United States Patent
Custodis et al.

(10) Patent No.: US 6,696,781 B2
(45) Date of Patent: Feb. 24, 2004

(54) SILENT DISCHARGE LAMP WITH CONTROLLABLE COLOR

(75) Inventors: Udo Custodis, München (DE); Angela Eberhardt, Augsburg (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 10/203,753

(22) PCT Filed: Nov. 15, 2001

(86) PCT No.: PCT/DE01/04281

§ 371 (c)(1),
(2), (4) Date: Aug. 13, 2002

(87) PCT Pub. No.: WO02/50873

PCT Pub. Date: Jun. 27, 2002

(65) Prior Publication Data

US 2003/0020405 A1 Jan. 30, 2003

(30) Foreign Application Priority Data

Dec. 20, 2000 (DE) ..... 100 63 930

(51) Int. Cl.[7] ..... H01J 1/62

(52) U.S. Cl. ..... 313/483; 313/581; 313/584; 313/586; 345/103; 345/67; 345/22; 315/169.4

(58) Field of Search ..... 315/246, 260, 315/169.4, 169.1, 326, 358, 312; 313/581–587, 573, 574, 576, 641, 642, 483, 484, 567; 345/102, 103, 66, 67, 22

(56) References Cited

U.S. PATENT DOCUMENTS

| | | | | |
|---|---|---|---|---|
| 5,387,921 A | * | 2/1995 | Zhang et al. | 345/102 |
| 5,444,335 A | | 8/1995 | Matsumoto et al. | 315/246 |
| 5,461,397 A | * | 10/1995 | Zhang et al. | 345/102 |
| 5,818,175 A | * | 10/1998 | Yoshioka et al. | 315/169.4 |
| 6,297,599 B1 | * | 10/2001 | Dirscherl et al. | 315/260 |
| 6,373,185 B1 | * | 4/2002 | Tyler | 313/491 |
| 6,376,989 B1 | | 4/2002 | Vollkommer et al. | 315/DIG. 4 |
| 6,388,374 B1 | | 5/2002 | Vollkommer et al. | 313/491 |

FOREIGN PATENT DOCUMENTS

| | | |
|---|---|---|
| DE | 198 44 720 | 4/2000 |
| DE | 198 45 228 | 4/2000 |
| EP | 0 926 705 | 6/1999 |
| WO | WO 99/34409 | 7/1999 |
| WO | WO 00/19485 | 4/2000 |
| WO | WO 00/21116 | 4/2000 |
| WO | WO 00/79334 | 12/2000 |

* cited by examiner

*Primary Examiner*—Haissa Philogene
(74) *Attorney, Agent, or Firm*—Robert F. Clark

(57) ABSTRACT

A silent discharge lamp which comprises a discharge vessel filled with a gas fill, a plurality of electrodes divided into separately operable groups, a dielectric layer between at least one anode part of the electrodes and the gas fill, and a luminescent layer which has elementary luminescent surfaces of at least two respective luminescent colors. Each elementary luminescent surface is assigned to a different electrode group. The electrode groups and the elementary luminescent surfaces are in each case two-dimensionally interleaved relative to one another so that the light emission surface of the gas discharge lamp can essentially be lit using each electrode group on its own, and the gas discharge lamp is designed so that it is possible to control the color of the light emission by controlling simultaneous operation of the electrode groups.

10 Claims, 3 Drawing Sheets

SILENT DISCHARGE LAMP WITH CONTROLLABLE COLOR

TECHNICAL FIELD

The present invention relates to a so-called silent gas discharge lamp. This term refers to gas discharge lamps that are designed for so-called dielectric barrier discharges. To that end, at least the anode(s) is or are separated by a dielectric layer from the gas fill that is used as the discharge medium. In the case of gas discharge lamps designed for bipolar operation, all the electrodes have dielectric barriers.

BACKGROUND ART

Silent discharge lamps are known per se. They are advantageous for various applications, including in particular the backlighting of displays in flat screens, etc. For this field of application, construction as a so-called flat panel lamp is known, in which the lamp consists essentially of two plane-parallel plates that can be connected via a frame and enclose the discharge medium between them. One of the two plates is in this case used as the light emission surface of the flat panel lamp.

These silent gas discharge lamps are preferably operated with a pulsed operating method, with which a particularly high efficiency can be achieved in the generation of light (UV light or, preferably, visible light when luminescent materials are used). The specifics of this operating method are also prior art and are familiar to the person skilled in the art, so that details need not be entered into here.

It is furthermore known to use, in a silent gas discharge lamp, an electrode arrangement divided into several groups, wherein the groups can be operated separately from one another. In this way, for example, it is possible to illuminate different areas of an instrument arrangement independently of one another, and to switch this illumination on and off for the different areas, with only one lamp being used in total. In this case, the various areas of the instrument illumination may be colored differently, i.e. luminescent materials or luminescent mixtures having different colors may be used. Reference is made to U.S. Pat. No. 6,388,374.

SUMMARY OF THE INVENTION

It is a technical object of this invention to extend the field of use and the possible applications of silent discharge lamps.

To that end, on the one hand, the invention provides a gas discharge lamp having a discharge vessel filled with a gas fill, and having a plurality of electrodes divided into separately operable groups, a dielectric layer between at least one anode part of the electrodes and the gas fill, and a luminescent layer, wherein the luminescent layer has elementary luminescent surfaces of at least two respective luminescent colors assigned to the electrode groups, the electrode groups and the elementary luminescent surfaces are in each case two-dimensionally interleaved relative to one another so that the light emission surface of the gas discharge lamp can essentially be lit using each electrode group on its own, and the gas discharge lamp is designed so that it is possible to control the color of the light emission by controlling simultaneous operation of the electrode groups.

The invention also concerns an operating method for such a gas discharge lamp, in which the electrode groups are operated simultaneously with a respectively controlled power, and the relative proportions of the light colors emitted by the luminescent materials are controlled in this way.

Preferred configurations are indicated in the respective dependent claims.

Lastly, the invention also concerns an image display device having a plurality of such gas discharge lamps, which will be discussed in more detail later in the description.

The basic idea of the invention is that the overall color of the light emission from the discharge lamp should be controllable, specifically as a color mixture comprising at least two colors of luminescent materials or luminescent mixtures. To that end, as is known per se, the electrodes are divided into groups that can be operated separately from one another. Each of the electrode groups is assigned to a luminescent surface, which forms an elementary surface of the overall light emission surface of the gas discharge lamp. This elementary luminescent surface is provided with a respective luminescent material or luminescent mixture, and generates a particular color during operation of the lamp. The operation of an electrode group hence entails emission of light with the assigned luminescent substance (mixture) color. In this case, however, the overall emission should have the effect of a color mixture, i.e. as far as possible during use, the individual elementary luminescent surfaces should no longer be resolvable by the observer's eye if the observation distance is appropriate or, in the case of diffusion, by diffuser elements of the discharge lamp or by reflection from illuminated objects or the like, to which end the positions of the electrode groups and the assigned elementary luminescent surfaces are interleaved relative to one another. How fine the structure of this positional interleaving should be depends on the special application. In any event, the elementary luminescent surfaces should not form self-contained separate compact blocks within the overall light emission surface of the gas discharge lamp, but rather should be multiply interdigitated or otherwise interleaved with one another in relation to this overall surface for light emission. In other words, it should be possible for the overall light emission surface to be essentially lit by each electrode group on its own.

With these measures according to the invention, one or other of the at least two luminescent colors can now be produced during operation of the lamp, and a color mixture can be produced therefrom by simultaneous operation. As it has moreover been found that silent discharge lamps of this type can be dimmed, which also applies to individual electrode groups, not only can a particular color mixture be generated by simultaneous operation of the electrode groups with the different luminescent colors, but this color mixture can also be varied continuously.

With regard to suitable dimming methods and measures expedient for this, reference is made to two prior patent applications by the same Applicant, to the content of which reference is made in relation to the power control in the individual electrode groups and also in relation to preferred features of the electrode structure within these electrode groups. They are, on the one hand, U.S. Pat. No. 6,376,989 and, on the other hand, WO 00/21116. To avoid making the present application unnecessarily long, the content of these cited applications will not be repeated. It is therefore assumed that, with suitable electrode structures, in particular those with a discharge gap that varies monotonically within so-called control lengths, the power of the lamp can be controlled continuously in relatively large ranges by varying parameters of the electrical power supply, in particular the voltage amplitude in the pulsed operating mode or the dead time between the pulses. In particular, by establishing particularly short discharge gaps in a part of the electrode pair and by an associated operating method with particularly long dead times, operation at very small power levels can further take place. In the present context, this is to be understood as meaning that an electrode group corresponding to a luminescent color may actually contain different discharge gaps, i.e. subgroups can be formed in connection with the dimming method.

In principle, the invention according to the aforementioned embodiments requires only two primary colors, with which it is possible to cover a color mixture spectrum extending as far as the pure primary colors. Greater configurational latitude is naturally obtained with a greater number of primary colors, in which case three primary colors with three electrode groups are in principle sufficient (the term "electrode groups" will be used below to denote the group division involved in the color control). The specifics of the allocation of particular luminescent materials to different primary colors and the details of the color mixing in fluorescent lamps will not be entered into here, because this also involves basic knowledge of the person skilled in the art and the prior art. In particular, VUV-excitation luminescent materials suitable for silent discharge lamps are also known from prior applications.

For the sake of clarity, it should be added that the elementary luminescent surfaces need not be clearly delimited from one another, but may also merge into one another. With the customary manufacturing methods, however, a defined boundary between the elementary luminescent surfaces is generally to be found. Further, as already mentioned, the groups may also be divided into subgroups, e.g. in connection with the dimming properties. Each of the associated elementary luminescent surfaces need not continue without interruption, but may instead consist of a plurality of individual fields on the light emission surface, each of which is self-contained.

One possible application of the invention is to produce white light with an adjustable color temperature. In conventional gas discharge lamps, white light is produced by combined excitation of a so-called three-band mixture of different luminescent materials. In this case, the luminescent materials or luminescent mixtures corresponding to the three primary colors (three bands) are therefore mixed together.

In such conventional gas discharge lamps, the color temperature of the white hue can be adjusted only through the quantitative proportions of the colored materials in the overall colored mixture. For each desired color temperature, a separate colored mixture and therefore a separate gas discharge lamp hence needs to be manufactured, as well as purchased and stored by the user. Conversely, with the procedure according to the invention, it is possible to manufacture a silent gas discharge lamp in which, besides the overall brightness, the color temperature can also be set by fine adjustment of the respective power of the individual electrode groups. In principle, this argument naturally also applies to other hues besides white light, although the commercial importance attached to white light with different color temperatures is the greatest.

In this case, moreover, other advantages can also be achieved besides adjustment by the user: for example, standardized lamps may be equipped with different ballasts, so as to produce various color temperatures depending on the application. The option of adjustment by the user might then be superfluous, for example because only a fairly small number of different standard color temperatures are inherently of interest. A ballast offering the opportunity to switch between different preset color temperatures may also be provided.

On the other hand, it may however also be advantageous to be able to generate a fairly large color spectrum, or as complete a color spectrum as possible, with a gas discharge lamp according to the invention. This applies, in particular, to a preferred application of the lamps according to the invention as picture elements of a fairly large image display device. Here, this image display device consists of a plurality of gas discharge lamps which are arranged next to one another in a plane, and each of which therefore forms a full color pixel. The image information may in this case be produced by controlling the brightness of the individual pixels, i.e. lamps, in which case the overall image display device can be operated as a color display device according to the colors that the individual pixels can represent. In comparison with a conventional color picture tube, the individual lamp then corresponds to a set of adjacent primary color pixels (usually three). It is, however, also possible for the gas discharge lamps according to the invention to be used merely for generating the required colors in the image display device, and for the actual pictorial image information to be represented independently of this, for instance by an LCD display or other brightness filter arranged in front of it.

For details of such an image display device, reference is moreover made to the exemplary embodiments.

BRIEF DESCRIPTION OF THE DRAWINGS

The invention will be explained in more detail below with the aid of exemplary embodiments that are represented in the figures. In the preceding description, as well as the description below, the disclosed features are to be taken both in the context of the device category and in the context of the method category.

DETAILED DESCRIPTION OF THE INVENTION

Figure 1:
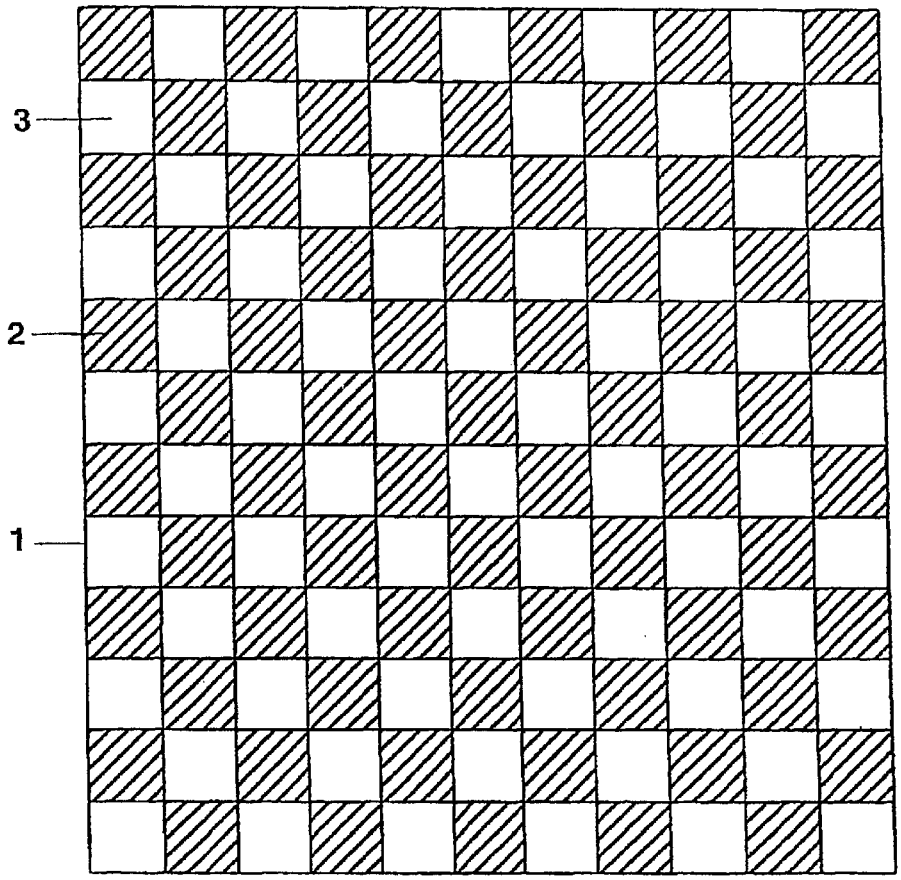
FIG. 1 schematically shows the structure of a light emission surface of a silent gas discharge lamp having two elementary luminescent surfaces that each correspond to primary colors.

FIG. 1 schematically shows the flat structure of a light emission surface 1 of a silent gas discharge lamp. In this case, the light emission surface 1 corresponds essentially to the optically transmissive cover plate of a silent flat panel lamp that is conventional apart from the details explained below. It can be seen that the light emission surface 1 is divided in a checkerboard pattern into two elementary luminescent surfaces 2 and 3. The elementary luminescent surfaces 2 and 3 are in this case to be understood as being the sum of the respective light and dark squares, each elementary luminescent surface 2 and 3 hence forming half of the light emission surface and being capable, even when activated on its own, of illuminating the light emission surface 1 essentially fully. Owing to the relatively fine checkerboard-pattern interleaving between the elementary luminescent surfaces 2 and 3, at a certain observation distance the eye can here no longer distinguish which of the elementary luminescent surfaces 2 or 3 is excited to emit light. Naturally, this does not apply to the different colors that are provided by the luminescent materials or luminescent mixtures of the elementary luminescent surfaces 2 and 3. In this example, the elementary luminescent surface 2 is intended to emit a blue hue and the elementary luminescent surface 3 is intended to emit a yellow hue. Hence, besides the hues blue and yellow, it is thereby also possible to represent hues in a continuous green spectrum that results from mixing the two primary colors.

The uniformity can be further enhanced by also interposing, in front of the discharge lamp, a diffuser element that is known per se for smoothing the light density distribution in display screen backlighting systems, for example a prism film or a matt sheet.

Figure 2:
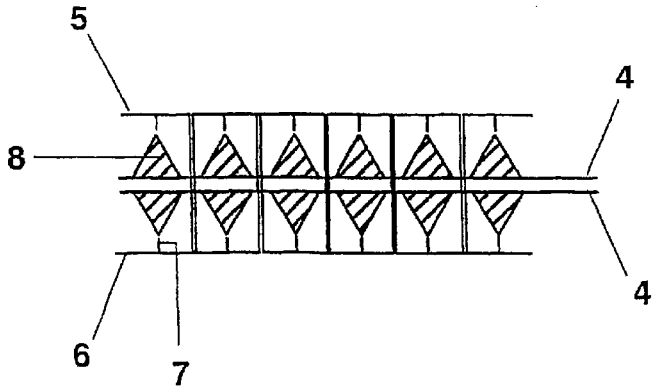
FIG. 2 schematically illustrates a suitable electrode structure for this.

FIG. 2 shows an example of an electrode structure suited to FIG. 1. The two central horizontal lines 4 correspond in this case to two anodes, and the electrode strips 5 and 6 meandering, so to speak, at right angles around these anodes 4 are cathodes that can be operated separately from one another, each with projections 7 for localizing individual discharge structures 8. The cathode 5 is illustrated by broken lines, so as to distinguish it from the cathode 6; naturally, however, it is in fact a continuous track.

The separate operability of the cathodes 5 and 6 creates two electrode groups 4, 5 and 4, 6 (with common anodes), to which the discharge structures schematically indicated as respective triangles are assigned. In the figure, simultaneous operation of both electrode groups is hence assumed.

It is self-evident that the electrode strips 4, 5, 6 need to be insulated from one another at the intersection points and in the regions where they pass relatively close to one another. To that end, a corresponding safety distance (not pictorially represented in FIG. 2) may be provided between the cathode strips 5 and 6, in particular in the neighboring regions.

It is self-evident that the squares that are respectively enclosed between the cathodes 5 and 6 and the anodes 4, and in which the individual discharge structures 8 are located, are arranged directly under the individual squares of the elementary luminescent surfaces 2 and 3 in the lamp. In this way, the electrode groups 4, 5 and 4, 6 are respectively assigned to one of the two elementary luminescent surfaces 2 and 3. Depending on the size of the individual squares, and as a function of the distance between the discharge structures 8 and the elementary luminescent surfaces (perpendicular to the plane of the drawing as shown in the figures), when one of the two electrode groups 4, 5 and 4, 6 is in operation, some degree of excitation of the other elementary luminescent surface not actually assigned to it will naturally also occur. This slightly impairs the purity of the primary colors when only one of the two electrode groups 4, 5 and 4, 6 is being operated, but it does not fundamentally change the basic principle of the representability of all color mixtures between the primary colors that can be represented.

Figure 3:
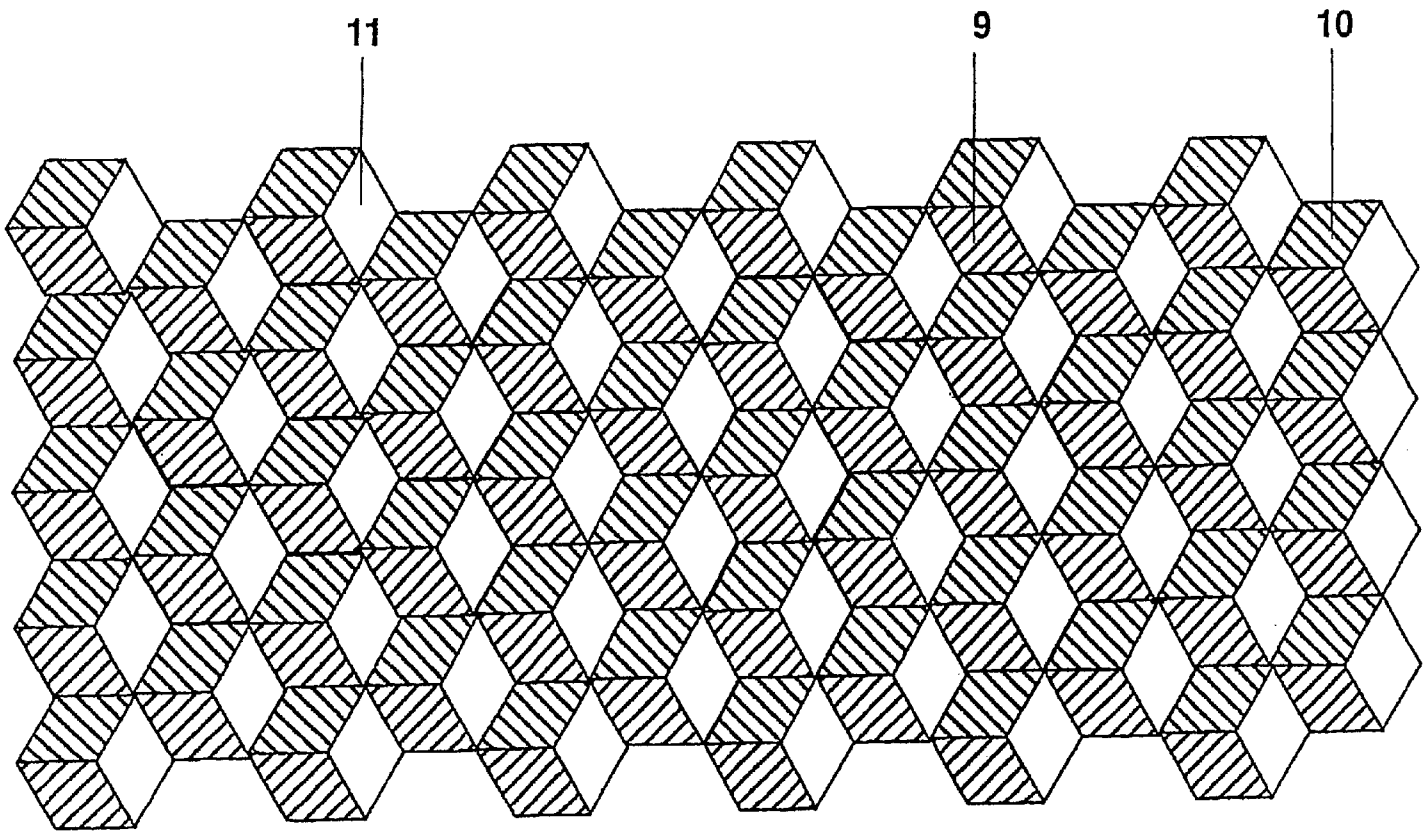
FIG. 3 illustrates the structure of a variant of FIG. 1, namely the interleaving of three elementary luminescent surfaces that each correspond to primary colors.

FIG. 3 shows a variant of the pattern in FIG. 1, which is configured for three primary colors. The elementary luminescent surfaces are denoted 9, 10 and 11, and in this variant correspond to the primary colors blue at 9, green at 10 and red at 11. A correspondingly constructed gas discharge lamp is therefore in principle capable of displaying a full color spectrum. In other respects, the comments about FIG. 1 apply. The electrode structure needed for the variant in FIG. 3 is naturally somewhat more complex than the one represented in FIG. 2, and will not be explained in detail here because nothing fundamentally new comes from it.

Figure 4:
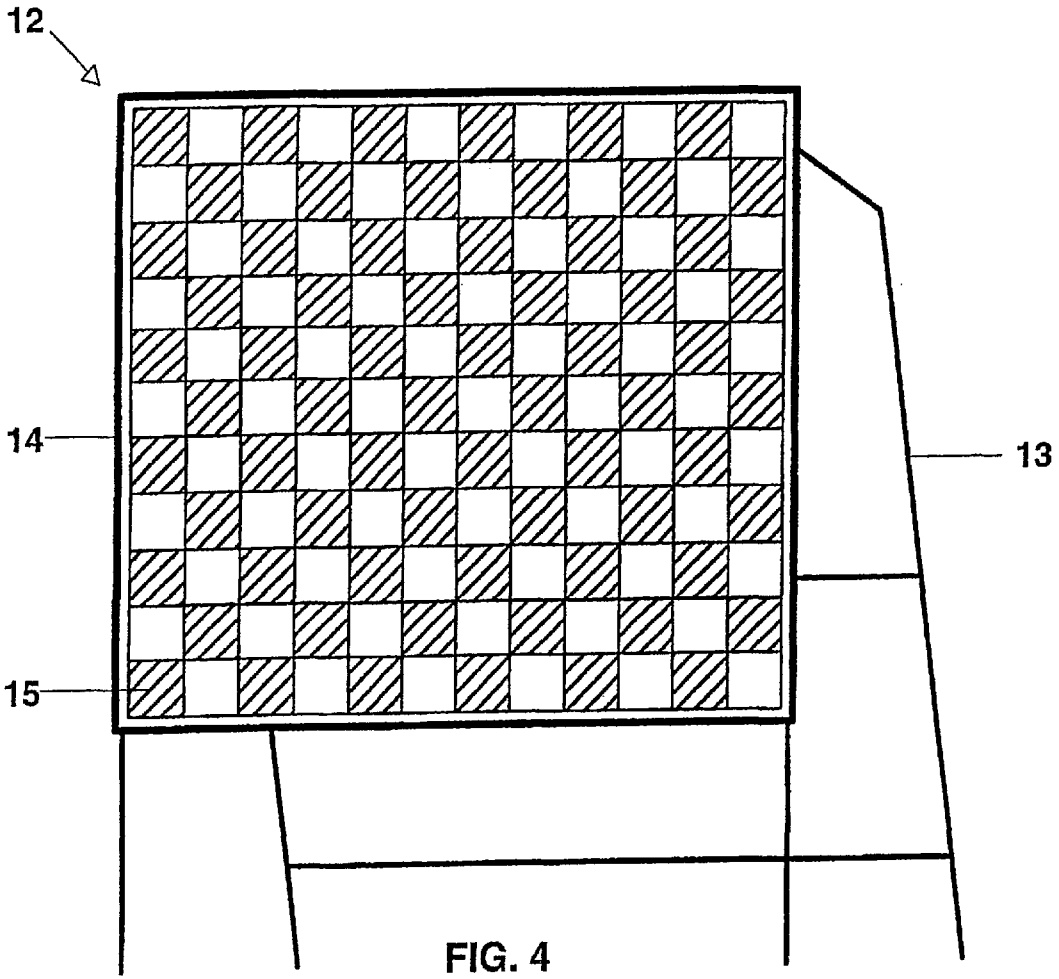
FIG. 4 schematically illustrates an image display device according to the invention that can be constructed from silent gas discharge lamps according to FIGS. 1–3.

FIG. 4 schematically shows a large-format image display device 12 with a stand 13 which supports a large-format rectangular flat display screen wall 14 so that it is upright and raised above the ground. Such an image display device 12 could, for example, be used as an information screen in a large sports stadium or could be mounted, for example, as an advertising panel on house walls, in the latter case naturally without the stand 13 shown here.

The flat display screen wall 14 consists essentially of a large number of individual gas discharge lamps 15, which are mounted next to one another in a plane and are constructed according to FIGS. 1 and 2 or according to FIG. 3. In this way, they form full color pixels for a color representation with two or three primary colors, respectively. The graphical image information (i.e. light/dark information) in this case has a spatial resolution corresponding to the size of the individual gas discharge lamps 15. The flat display screen wall 14 should hence be configured in such a way that, at an acceptable observation distance, the observer can overall see an image and preferably no longer perceives the individual lamps per se.

The comment already made in the introduction to the description moreover applies, that by subdividing the individual lamps, it is also possible to achieve a higher spatial resolution of the graphical representation and the color representation than that which corresponds to the individual lamp size. This is essentially a question of economics, that is to say depending on whether a set of smaller lamps or a larger lamp that corresponds to the format of the full set, but is subdivided, is more cost-effective to manufacture.

An essential advantage of using silent discharge lamps for image display devices 12, as in FIG. 4, is that a very high light density can be achieved using the silent discharge lamps with an discharge lamps for image display devices 12, as in FIG. 4, is that a very high light density can be achieved using the silent discharge lamps with an acceptable consumption of electricity. Furthermore, silent discharge lamps are extraordinarily switchproof, i.e. well suited to time-varying continuous applications. They also exhibit virtually no start-up behavior or temperature dependency of the luminous power. These advantages are particularly suitable for applications of such image display devices in sports stadiums, for concert broadcasts, in advertising, in traffic control systems and in all other applications for which large-format image representation is important.

What is claimed is:

1. A gas discharge lamp having a discharge vessel filled with a gas fill, and having a plurality of electrodes divided into separately operable groups, a dielectric layer between at least one anode part of the electrodes and the gas fill, and a luminescent layer, wherein the luminescent layer has elementary luminescent surfaces of at least two respective luminescent colors and each elementary luminescent surface is assigned to a different electrode group, the electrode groups and the elementary luminescent surfaces are in each case two-dimensionally interleaved relative to one another, and the color of the light emission from the gas discharge lamp is controlled by simultaneous operation of the electrode groups.

2. The gas discharge lamp as claimed in claim 1, in which three elementary luminescent surfaces are each provided with one luminescent primary color.

3. The gas discharge lamp as claimed in claim 1, wherein the electrode groups are controlled to produce white light with an adjustable color temperature.

4. The gas discharge lamp as claimed in claim 1 wherein the lamp is a flat panel lamp.

5. The gas discharge lamp as claimed in claim 3 wherein the color temperature of the white light is adjusted by controlling the relative proportions of the light emitted by the elementary luminescent surfaces.

6. The gas discharge lamp as claimed in claim 1 wherein the electrode groups are operated simultaneously with a respectively controlled power.

7. An image display device comprising:

a plurality of gas discharge lamps arranged next to one another in a plane to form a display surface in which each gas discharge lamp corresponds to a full color pixel;

each gas discharge lamp having a discharge vessel filled with a gas fill, and having a plurality of electrodes divided into separately operable groups, a dielectric layer between at least one anode part of the electrodes and the gas fill, and a luminescent layer, wherein the luminescent layer has elementary luminescent surfaces of at least two respective luminescent colors and each elementary luminescent surface is assigned to a different electrode group, the electrode groups and the elementary luminescent surfaces are in each case two-dimensionally interleaved relative to one another, and the color of the light emission from each gas discharge lamp is controlled by simultaneous operation of the electrode groups of each lamp.

8. The image display device as claimed in claim 7 wherein each gas discharge lamp has three elementary luminescent surfaces which are each provided with one luminescent primary color.

9. The image display device as claimed in claim 7 wherein each gas discharge lamp is a flat panel lamp.

10. The image display device as claimed in claim 7 wherein the display surface generates an image by controlling the color emission of the individual gas lamps.

* * * * *